US007900704B2

(12) United States Patent
Robertson

(10) Patent No.: US 7,900,704 B2
(45) **Date of Patent: *Mar. 8, 2011**

(54) PERFORATING TORCH APPARATUS AND METHOD

(75) Inventor: Michael C. Robertson, Arlington, TX (US)

(73) Assignee: Robertson Intellectual Properties, LLC, Arlington, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/661,449

(22) Filed: Mar. 17, 2010

(65) Prior Publication Data

US 2010/0175879 A1 Jul. 15, 2010

Related U.S. Application Data

(63) Continuation of application No. 12/128,272, filed on May 28, 2008, now Pat. No. 7,690,428.

(51) Int. Cl.
*E21B 43/116* (2006.01)

(52) U.S. Cl. ..... 166/298; 166/55; 166/63

(58) Field of Classification Search ..... 166/298, 166/301, 55, 63
See application file for complete search history.

(56) References Cited

U.S. PATENT DOCUMENTS

| | | | | |
|---|---|---|---|---|
| 4,298,063 | A | 11/1981 | Regalbuto et al. | |
| 4,413,677 | A | 11/1983 | Perkins | |
| 4,582,134 | A | 4/1986 | Gano et al. | |
| 4,598,769 | A | 7/1986 | Robertson | |
| 5,435,394 | A | 7/1995 | Robertson | |
| 5,791,417 | A | 8/1998 | Haugen et al. | |
| 6,478,093 | B1 | 11/2002 | Hilts et al. | |
| 6,564,868 | B1 | 5/2003 | Ferguson et al. | |
| 6,598,679 | B2 | 7/2003 | Robertson | |
| 6,971,449 | B1 | 12/2005 | Robertson | |
| 7,168,491 | B2 | 1/2007 | Malone et al. | |
| 7,195,067 | B2 | 3/2007 | Manke et al. | |
| 7,690,428 | B2 * | 4/2010 | Robertson | 166/298 |

* cited by examiner

*Primary Examiner* — William P Neuder
(74) *Attorney, Agent, or Firm* — The Matthews Firm

(57) ABSTRACT

A method of perforating a downhole pipe by cutting at a location within the pipe in a radial direction toward the pipe, producing a determined reaction force, and using the determined reaction force to enhance the cutting of the pipe. The method may include continuing cutting in the radial direction to create an opening in the pipe, and attenuating a pressure wave through the opening.

20 Claims, 9 Drawing Sheets

PERFORATING TORCH APPARATUS AND METHOD

CROSS-REFERENCE TO RELATED APPLICATIONS

This application is a continuation of U.S. patent application Ser. No. 12/128,272, filed on May 28, 2008 now U.S. Pat. No. 7,690,428.

BACKGROUND OF THE DISCLOSURE

1. Field of the Disclosure

The present disclosure relates to apparatuses and methods for perforating and/or cutting pipe in a borehole.

2. Description of the Related Art

In oil and gas wells, boreholes are drilled into the earth. Various types of pipe are lowered into the borehole. For example, casing provides a lining that is along the walls of the borehole. A drill string is a length of pipe used to drill the borehole. Coiled tubing is also used to drill. After drilling, tubing is located within the casing; oil and sometimes gas is produced to the surface through the tubing. In addition, wells are subjected to workover operations for maintenance.

Occasionally, it becomes necessary to cut the pipe at a location inside of the borehole. For example, if coiled tubing is being used to drill, the end of the tubing may become stuck and cannot be removed from the borehole. As another example, in a workover operation, downhole equipment may become stuck. Such a situation typically arises in boreholes having a cork screw profile. The tubing is cut near the stuck point, enabling most of the tubing to be withdrawn and salvaged for use in other wells.

A radial cutting torch, which is described in U.S. Pat. No. 6,598,679, may be used to cut pipe inside of boreholes. The radial cutting torch has proven to be successful.

However, there are situations where the radial cutting torch does not work well. Such situations arise where the pipe is blocked or closed below the radial cutting torch. For example, coiled tubing is typically run into a well with a check valve that prevents back flow of well fluids into the tubing. When the radial cutting torch is lowered into the tubing for a cutting operation, it is positioned some distance away from the check valve. The radial cutting torch uses hot combustion fluids directed radially out to cut the pipe. When ignited, the torch creates a pressure increase, or pressure wave, inside of the tubing. In an open pipe, the pressure wave propagates down the pipe to the bottom of the well. In a closed pipe, the pressure wave reflects off of the check valve or other closure back to the torch. The pressure wave jostles the torch, causing the torch to move from its position. This in turn spreads the hot combustion fluids over a larger area of the pipe, in effect distributing the cutting fluids over a larger area of the pipe due to tool movement to the point where the pipe is not cut.

One solution would be to locate the cutting torch a sufficient distance away from the closure to mitigate the pressure wave. In small diameter pipe, such as coiled tubing, this distance must be great, resulting in waste, as a long length of pipe must be left in the hole.

Thus, it is desired to cut pipe close to a blockage or closure.

SUMMARY OF THE DISCLOSURE

The present disclosure provides a method of perforating a downhole pipe by cutting at a location within the pipe in a radial direction toward the pipe; producing a determined reaction force; and using the determined reaction force to enhance the cutting of the pipe.

In one embodiment, the method may include continuing cutting in the radial direction to create an opening in the pipe. In another embodiment, the method may also include attenuating a pressure wave through the opening.

The present disclosure provides a method of perforating a downhole pipe in proximity to a closure in the pipe. The pipe has a longitudinal axis. A cutter is positioned in the pipe in proximity to the closure. Using the cutter, cutting fluids are produced in a first radial direction toward the pipe. The production of cutting fluids produces a reaction force as well as a pressure wave in the pipe that is reflected off of the closure and back to the cutter. The reaction force is used to move the cutter against the pipe, wherein the cutter is temporarily anchored to the pipe when the reflected pressure wave impinges on the cutter. While the cutter is anchored against the pipe with the reaction force, the production of cutting fluids continues in the first radial direction so as to create an opening in the pipe.

In accordance with one aspect of embodiments disclosed herein, the cutter is located a distance from the closure, the production of a reaction force further comprises producing a reaction force of a determined magnitude based on the distance of the cutter from the closure.

In accordance with another aspect of the present disclosure, there is a clearance between the cutter and the pipe, the production of a reaction force further comprises producing a reaction force of a determined magnitude based on a clearance between the cutter and the pipe.

In accordance with still another aspect of the present disclosure, the pipe has a drilling fluid with a density, the production of a reaction force further comprises producing a reaction force of a determined magnitude based on the density of the drilling fluid.

In accordance with still another aspect of the present disclosure, the pipe has a wall thickness and the opening has a size, the production of a reaction force further comprises producing a reaction force of a determined magnitude based on the pipe wall thickness and the opening size.

In accordance with still another aspect of the present disclosure, the cutter is located a distance from the closure, there is a clearance between the cutter and the pipe, the pipe has a drilling fluid and density, the pipe has a wall thickness and the opening has a size, the production of a reaction force further comprises producing a reaction force of a determined magnitude based on the distance of the cutter from the closure, the clearance between the cutter and the pipe, the density of the drilling fluid, the pipe wall thickness and the size of the opening.

In accordance with another aspect of the present disclosure, a radial cutter is positioned in the pipe in proximity to the closure, with the opening located between the radial cutter and the closure. The cutter is operated so as to radially cut the pipe.

Embodiments disclosed herein may also provide an apparatus for perforating a downhole pipe and comprising a fuel section having combustible material capable of producing cutting fluids. An igniter section is coupled to the fuel section and has an igniter that ignites the combustible material so as to produce cutting fluids. A nozzle section is in communication with the fuel section and has a cavity therein. The cavity has at least one opening that directs the cutting fluids in a first radial direction so as to produce a reaction force on the cutter opposite of the first radial direction. The cavity has a piston that moves between a closed position and an open position, with the closed position having the piston separate the opening from the fuel section and the open position allowing the fuel section to communicate with the opening.

In accordance with one aspect of the present disclosure, the piston has a seal.

In accordance with another aspect of the present disclosure, there are at least two openings in the nozzle section, the openings being spaced circumferentially relative to each other, the openings directing cutting fluids along parallel trajectories.

Other embodiments of the disclosure may also provide an apparatus for cutting a downhole pipe at a location in proximity to a closure of the pipe. A perforating tool and a cutting torch are provided. The perforating tool comprises an elongated body with a perforating igniter section, a perforating fuel section and a perforating nozzle section. The perforating fuel section has combustible material that is capable of producing cutting fluids. The perforating igniter section has an igniter that ignites the combustible material so as to produce cutting fluids. The perforating nozzle section is in communication with the perforating fuel section and has at least one opening that directs the cutting fluids in a first radial direction so as to produce a reaction force on the cutter opposite of the first radial direction. The cutting torch comprises an elongated body with a cutting igniter section, a cutting fuel section and a cutting nozzle section. The cutting fuel section has combustible material capable of producing cutting fluids. The cutting igniter section has a second igniter that ignites the combustible material in the cutter fuel section. The cutting nozzle section is in communication with the cutting fuel section and has a diverter that diverts the cutter cutting fluids radially outward in a circumferential manner.

The present disclosure also provides a method of perforating a downhole tubular that may include positioning a cutter in the tubular, where the cutter further may include a nozzle section and a piston disposed within the nozzle section actuatable between a first position and a second position; actuating the piston to the second position; producing cutting fluids in a first radial direction toward the tubular, such that the production of cutting fluids generates a reaction force; and using the reaction force to enhance the perforating of the downhole tubular.

DESCRIPTION OF DISCLOSED EMBODIMENTS

Embodiments disclosed herein may provide for an apparatus that can cut pipe in a borehole or well, which pipe has a closure or other type of pressure reflector. The present disclosure may provide for an apparatus that can do so without the use of anchoring devices.

Figure 1:
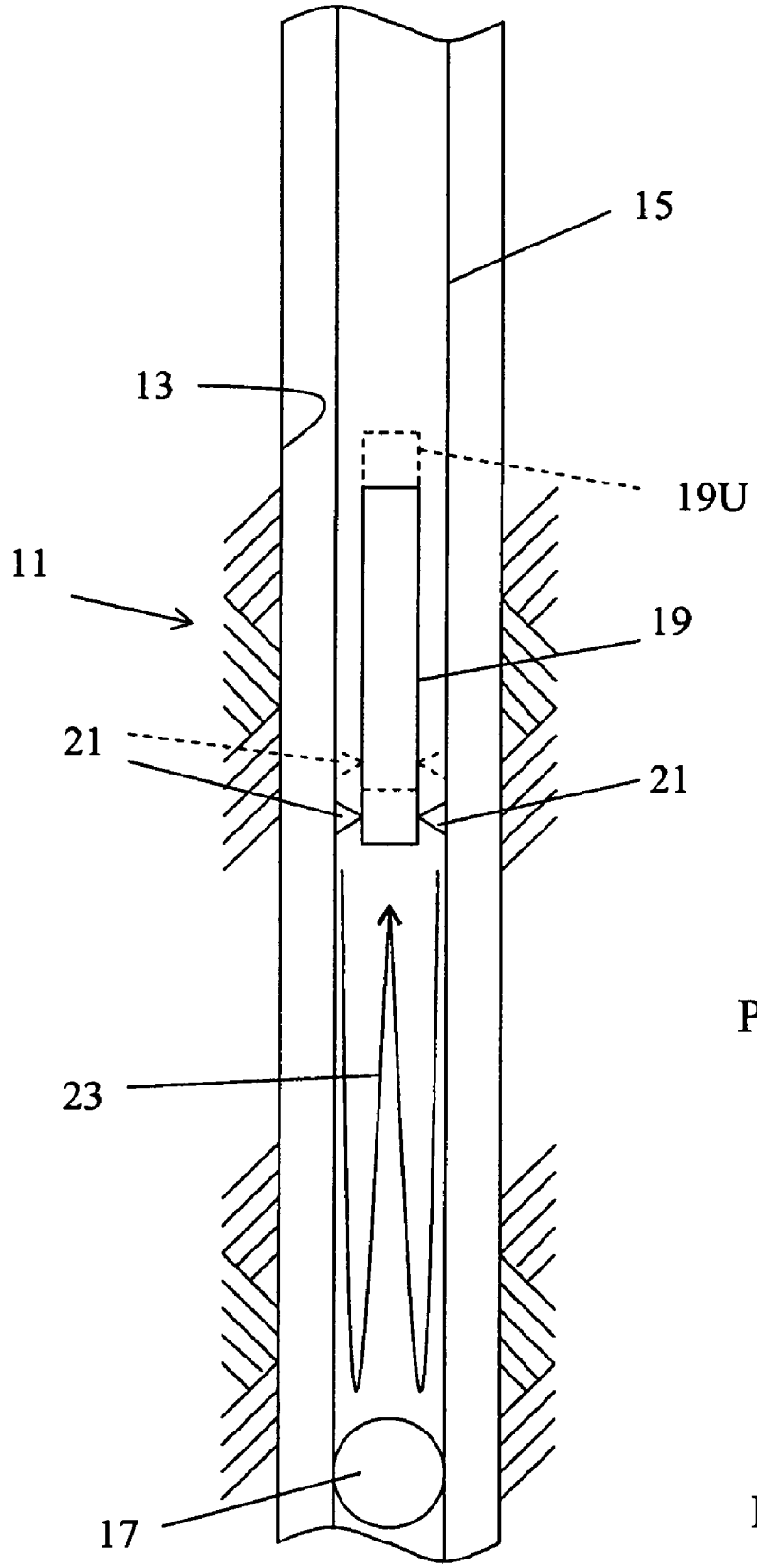
PRIOR ART Fig. 1
FIG. 1 is a cross-sectional view of a borehole showing a cutting torch operating in the closed pipe in accordance with the prior art.

FIG. 1 illustrates the problem with the prior art technique of cutting pipe with closures. There is shown a borehole or well 11, which is typically lined with casing 13. Tubing 15 is run into the borehole 11. The tubing 15 has a closure 17 located therein. The closure 17 can be a check valve, a flapper valve, a plug, a collapsed plug, etc.

The tubing 15 is to be cut. A cutting torch 19 is lowered into the tubing 15 to a location above the closure 17 (The pipe on which the cutting torch 19 is suspended is not shown for illustrative purposes). When the torch 19 is initiated, hot combustion fluids 21 are directed radially out from the torch. These combustion fluids create a pressure wave 23 that propagates down the pipe 15. Another pressure wave propagates up the pipe 15 to the surface, but is not a factor. The pressure wave 23 propagating down reflects, or bounces, off of the closure 17 back to the torch. The reflected pressure wave 23 impinges on the torch, moving the torch 19 U up, as shown by the dashed lines in FIG. 1. Likewise, the hot combustion fluids also move up to contact a new area of the pipe 15. Thus, the cutting fluids are distributed over a relatively wide band at the pipe 15, which effectively reduces the cutting ability of the cutting fluids.

Embodiments disclosed herein may provide for an apparatus that uses a perforating tool before the torch is used. The perforating tool cuts an opening in the pipe 15 at a location above the closure 17. Once the pipe is opened, the cutting torch is then used to cut the pipe. The pressure wave created by the cutting torch is vented through the opening. Any reflection of the pressure wave back toward the torch is attenuated so that the torch does not move. This results in a successful cutting of the pipe 15.

The perforating tool also creates a pressure wave when it creates the opening. This pressure wave is reflected off of the closure back to the tool. However, the perforating tool uses the reaction force of the cutting fluids it generates to anchor the tool against the tubing and so remain stationary even in the face of encountering the reflected pressure wave.

In the description that follows, the perforating tool will be described first, followed by a description of the cutting torch and then by a description of the operation of the perforating tool and cutting torch.

Figure 2:
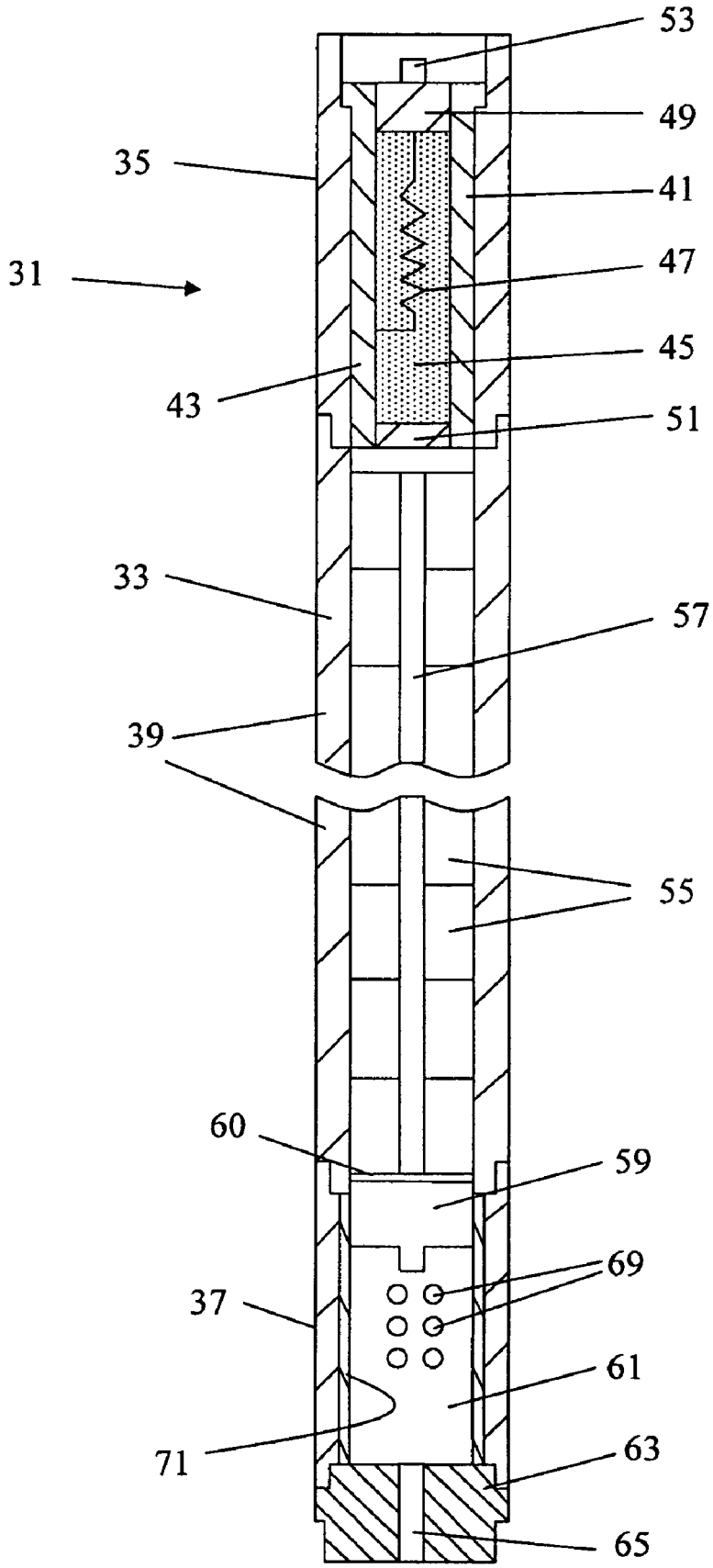
FIG. 2 is a longitudinal cross-sectional view of the perforating tool of the present disclosure, in accordance with an embodiment of the present disclosure.

The perforating tool 31 is shown in FIG. 2. The tool comprises an elongated tubular body 33 which has an ignition section 35 a nozzle section 37 and a fuel section 39 intermediate the ignition and fuel sections. In the preferred embodiment, the tubular body is made of three components coupled together by threads. Thus, the fuel section 39 is made from an elongated tube or body member, the ignition section 35 is made from a shorter extension member and the nozzle section 37 is made from a shorter head member.

The ignition section 35 contains an ignition source 41. In one preferred embodiment, the ignition source 41 is a thermal generator, previously described in my U.S. Pat. No. 6,925,937. The thermal generator 41 is a self-contained unit that can be inserted into the extension member. The thermal generator 41 has a body 43, flammable material 45 and a resistor 47. The ends of the tubular body 43 are closed with an upper end plug 49, and a lower end plug 51. The flammable material is located in the body between the end plugs. The upper end plug 49 has an electrical plug 53 or contact that connects to an electrical cable (not shown). The upper plug 49 is electrically insulated from the body 43. A resistor 47 is connected between the contact 53 and the body 43.

The flammable material 45 is a thermite, or modified thermite, mixture. The mixture includes a powered (or finely divided) metal and a powdered metal oxide. The powdered metal includes aluminum, magnesium, etc. The metal oxide includes cupric oxide, iron oxide, etc. In the preferred embodiment, the thermite mixture is cupric oxide and aluminum. When ignited, the flammable material produces an exothermic reaction. The flammable material has a high ignition point and is thermally conductive. The ignition point of cupric oxide and aluminum is about 1200 degrees Fahrenheit. Thus, to ignite the flammable material, the temperature must be brought up to at least the ignition point and preferably higher. It is believed that the ignition point of some thermite mixtures is as low as 900 degrees Fahrenheit.

The fuel section 39 contains the fuel. In the preferred embodiment, the fuel is made up of a stack of pellets 55 which are donut or toroidal shaped. The pellets are made of a combustible pyrotechnic material. When stacked, the holes in the center of the pellets are aligned together; these holes are filled with loose combustible material 57, which may be of the same material as the pellets. When the combustible material combusts, it generates hot combustion fluids that are sufficient to cut through a pipe wall, if properly directed. The combustion fluids comprise gasses and liquids.

The pellets 55 are adjacent to and abut a piston 59 at the lower end of the fuel section 39. The piston 59 can move into the nozzle section 37.

The nozzle section 37 has a hollow interior cavity 61. An end plug 63 is located opposite of the piston 59. The end plug 63 has a passage 65 therethrough to the exterior of the tool. The side wall 37 in the nozzle section has one or more openings 69 that allow communication between the interior and exterior of the nozzle section. The piston 59 has an o-ring 60 that provides a seal. The openings 69 and passage 65 are open to the fluid in the well, which fluid exerts hydrostatic pressure against the piston 59. The seal 60 seals the fuel section from the fluids in the nozzle section. A shoulder (not shown) may be used to prevent the piston 59 from moving up into the fuel section and thus compressing the fuel pellets 55. When the fuel pellets 55 are ignited, the pressure of combustion fluids generated by the ignited fuel moves the piston 59 moves into the nozzle section 37 and exposes the openings 69 to the combustion fluids. This allows the hot combustion fluids to exit the tool through the openings 69. The piston and nozzle section are sized so that all of the openings are cleared of the piston when the piston is fully pushed into the nozzle section. The nozzle section 37 has a carbon sleeve 71 liner, which protects the tubular metal body from the cutting fluids generated by the fuel section. The liner 71 is perforated at the openings 69.

Figure 3A:
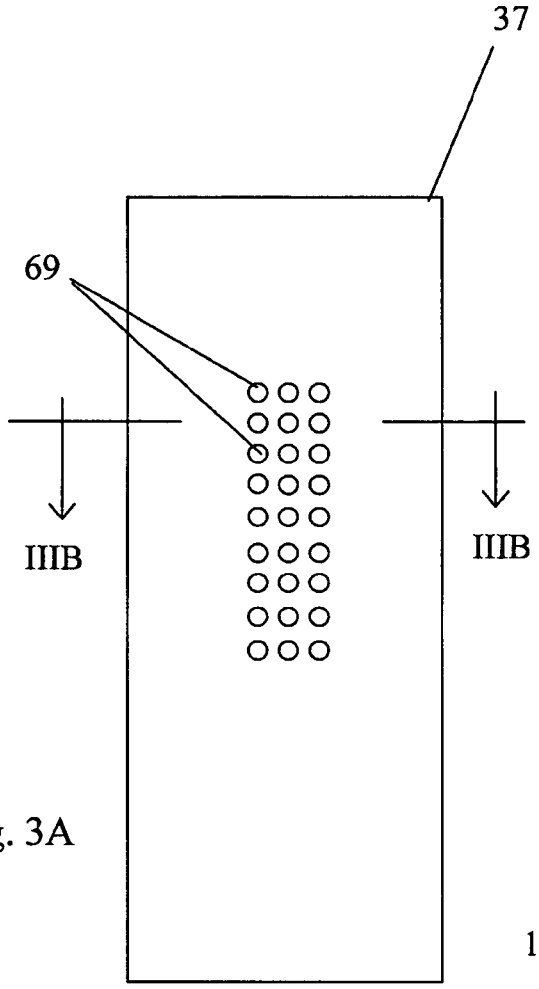
FIG. 3A is an elevational view of the pattern of openings on the perforating tool, in accordance with an embodiment of the present disclosure.
Figure 3B:
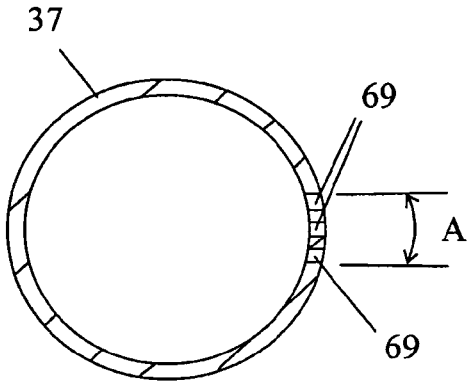
FIG. 3B is a cross-sectional view taken through lines IIIB-IIIB of FIG. 3A, in accordance with an embodiment of the present disclosure.
Figure 3D:
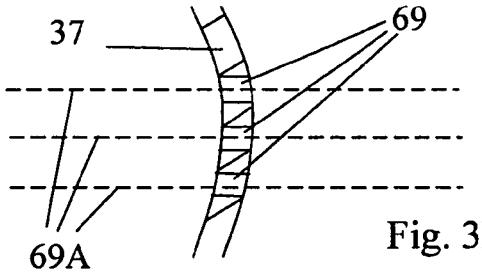
FIG. 3D is a detail view of the openings in the nozzle section, in accordance with an embodiment of the present disclosure.
Figure 3C:
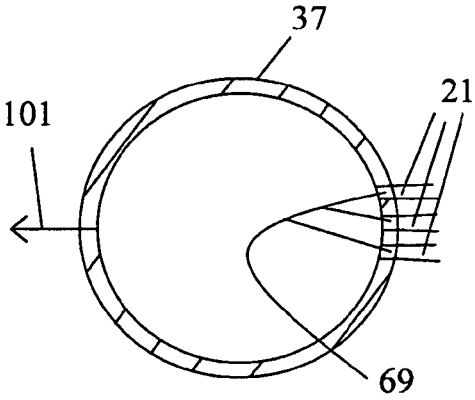
FIG. 3C is a cross-sectional view similar to FIG. 3B, showing the discharge of combustion fluids through openings, in accordance with an embodiment of the present disclosure.

In the preferred embodiment, plural nozzles are provided, which nozzles are arranged so as to produce cutting fluids 21 (see FIG. 3C) with parallel trajectories. This is accomplished by having the openings 69 formed into the nozzle section in a parallel manner, instead of a radial manner. FIG. 3D shows dashed lines 69 A, which are the central axes of the openings 69. As can be seen, these lines 69 A are parallel and do not converge to a center in the nozzle section. Having the openings produce cutting fluids with parallel trajectories produces a stronger reaction force 101 (see FIG. 3C). In addition, the parallel trajectories produce a cleaner opening; if the cutting fluids had radial trajectories, then interstitial spaces in the pipe may be left as a result of cutting fluids being spread too far apart.

In the embodiment shown in FIGS. 3A-3D, the openings 69 are arranged in the vertical pattern shown, with rows and columns. Typical sizes of the openings 69 range from 0.078-0.1875 inches in diameter. The openings have a circumferential arc A that can range from a single opening up to 40 degrees.

In other embodiments, the nozzle section 37 can have a single opening. The openings 69 can be rectangular in shape, having a height greater than a width. Alternatively, the openings can be square or circular (as shown).

The fuel is located only on one side or end of the nozzle section. This allows the nozzle section to be brought as close as possible to the closure and even into contact with the closure.

Figure 4:
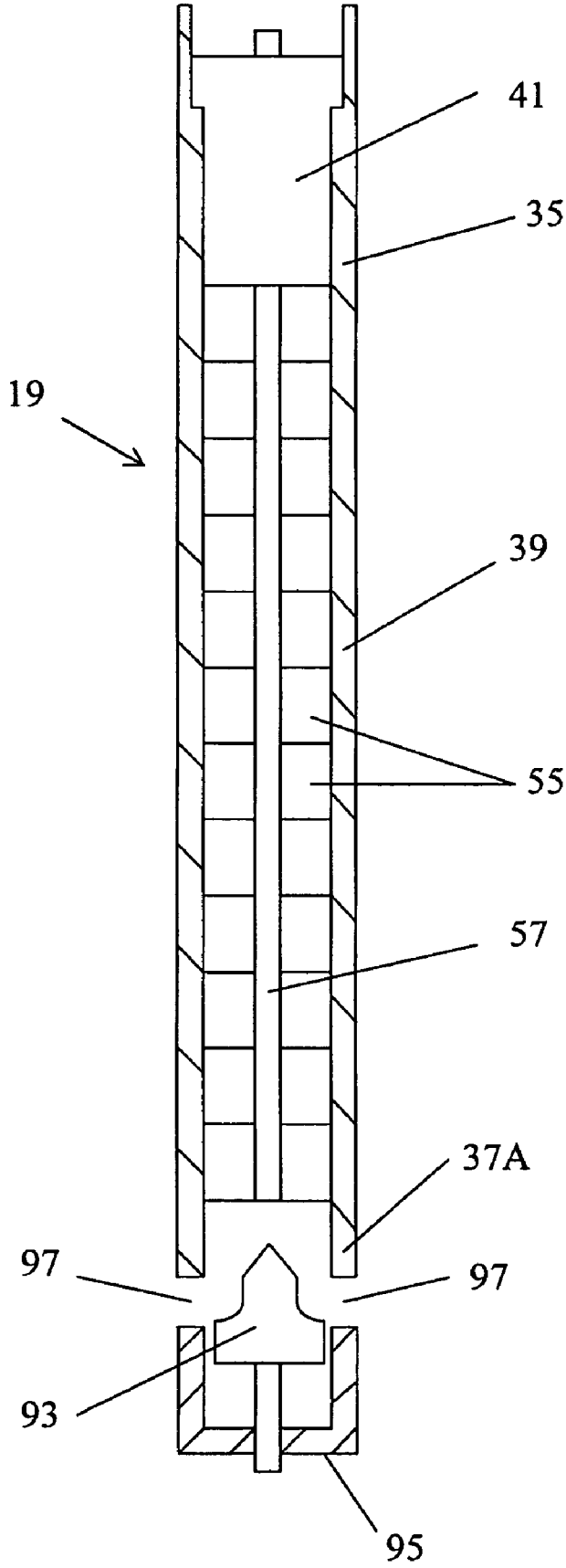
FIG. 4 is a longitudinal cross-sectional view of a radial cutting torch, in accordance with an embodiment of the present disclosure.

The radial cutting torch 19 (see FIG. 4) is similar to the perforating tool 31 in that it has ignition, fuel and nozzle sections 35, 39, 37A. And example of a radial cutting torch is described in detail in U.S. Pat. No. 6,598,679. The ignition and fuel sections 35, 39 are substantially similar to the perforating tool 31 ignition and fuel sections. Typically, the fuel section 39 of the radial cutting torch 19 will contain more fuel than the fuel section of the perforating tool 31. The nozzle section 37 A of the radial cutting torch 19 is different than the nozzle section 37 of the perforating tool; the nozzle section 37 A has a diverter 93 that diverts the combustion fluids radially out in a 360 degree pattern. A sleeve 95 or end cap is provided to close the bottom end of the torch. The sleeve slides along a shaft extending below the diverter 93. When the combustion fluids impact the sleeve 95, the sleeve slides down to create a 360 degree opening 97 that is aligned with the diverter 93. Thus, the hot combustion fluids are directed radially out from the tool 19.

Figure 5:
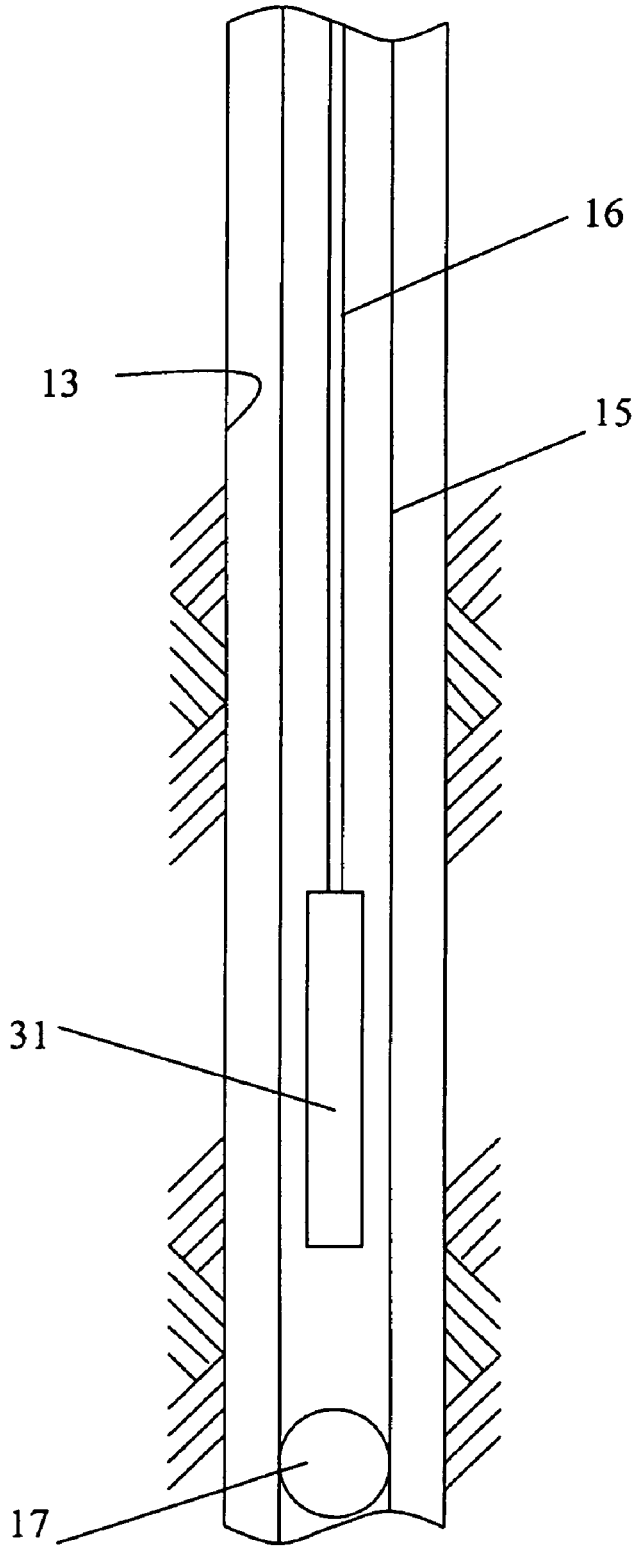
FIGS. 5-8 illustrate use of the perforating tool and cutting torch in closed pipe, in accordance with an embodiment of the present disclosure.
Figure 6:
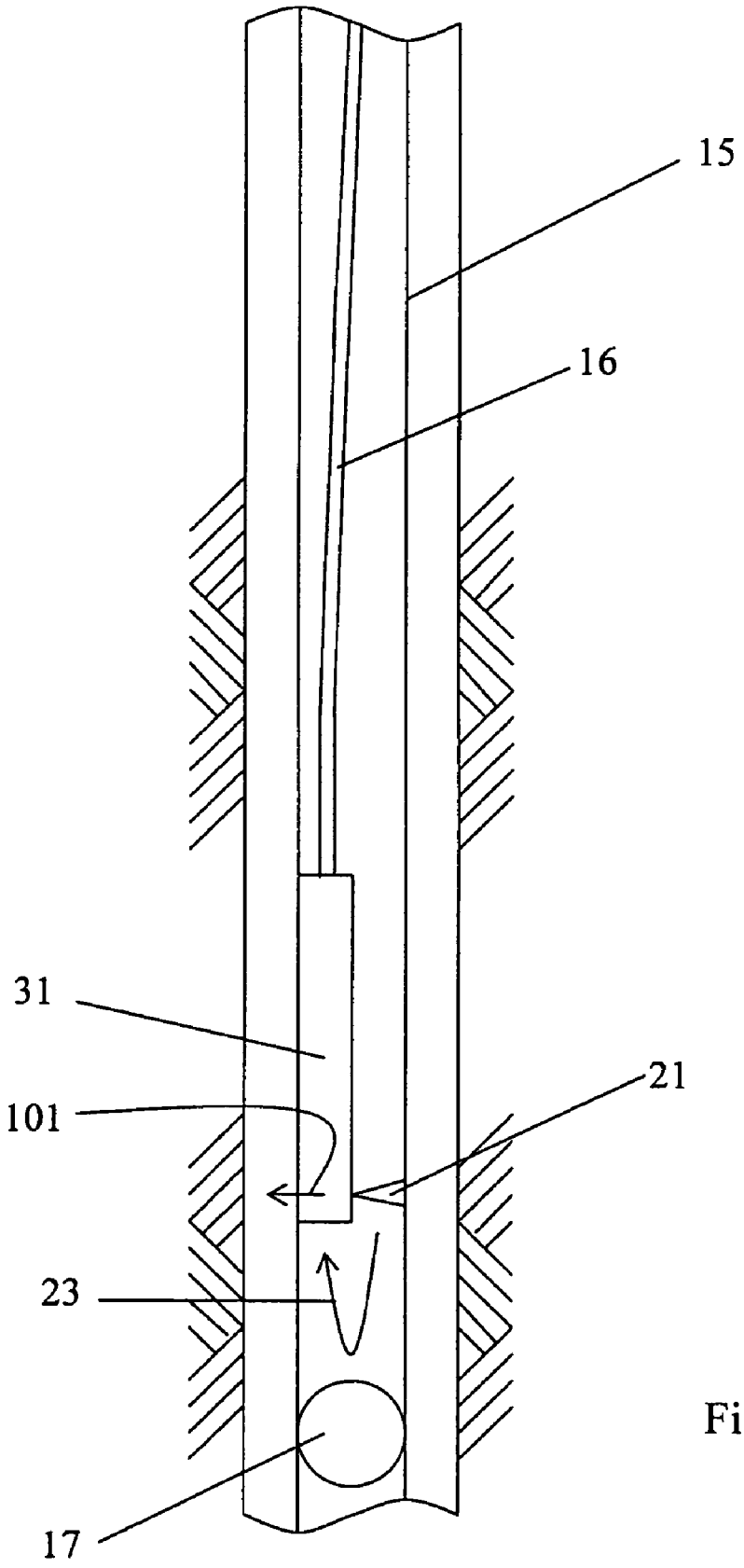
Figure 7:
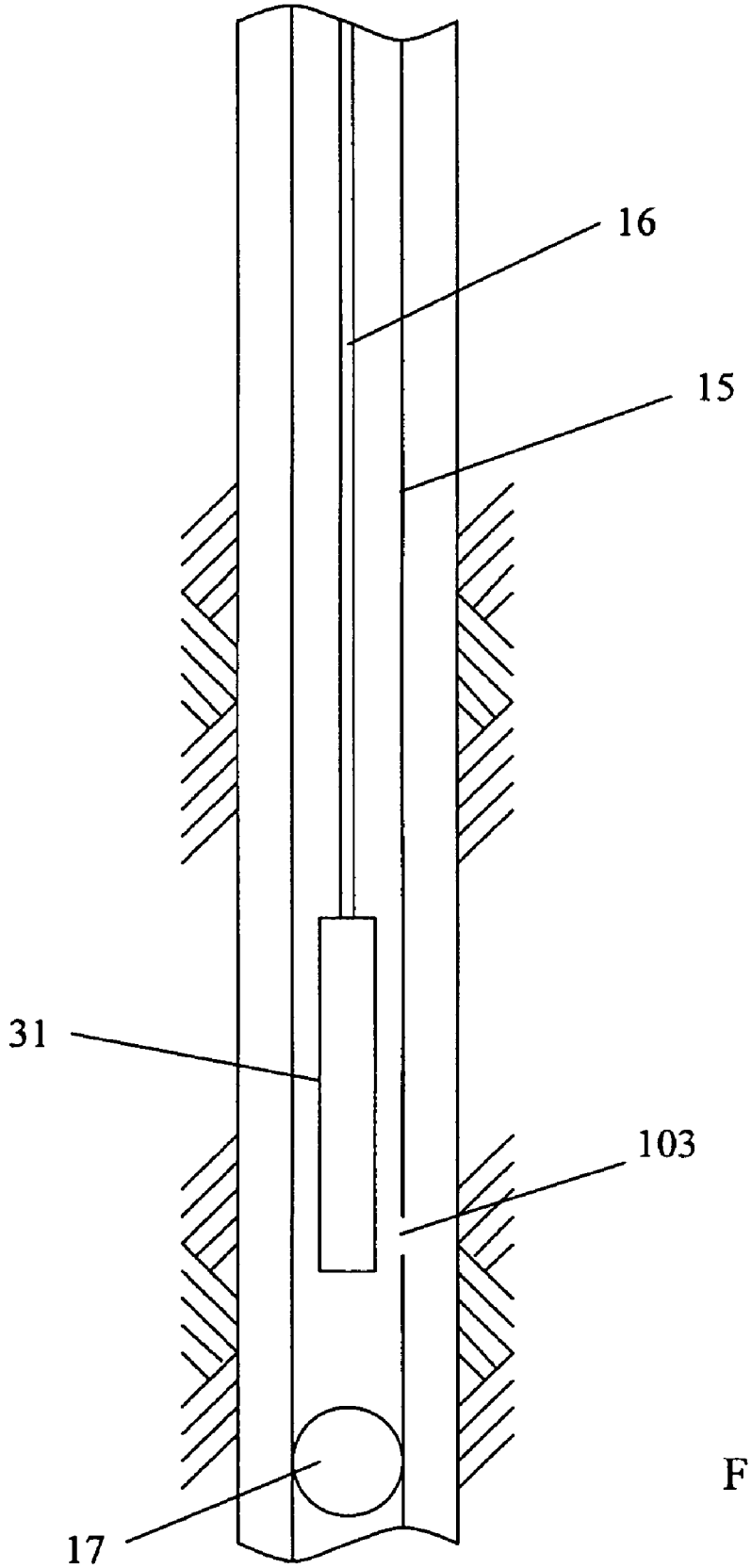

The operation and use of the perforating torch 31 and radial cutting torch 19 will now be described, using the example of plugged coiled tubing 15. Referring to FIG. 5, the perforating tool 31 is utilized first, before the radial cutting torch 19 is used. The perforating tool 31 is lowered into the pipe or tubing 15 which is to be cut by way of a wireline 16, such as an electric wireline. The perforating tool 31 can be located in contact with the closure 17, or can be located above the closure. Locating the perforating tool in contact with the closure increases the amount of pipe to be recovered, as the opening 103 (see FIG. 7) is located very close to the closure (In FIGS. 5-9, the perforating tool is shown out of contact with the closure to better illustrate the pressure waves).

When the perforating tool 31 is ready, it is set off. An electrical signal is provided to the igniter 41 (see FIG. 2), which ignites the fuel 57, 55. The combustion fluids produced by the fuel force the piston 59 down and expose the openings 69. The well fluids are expelled from the nozzle section through the openings 69 and the passage 65 by the movement of the piston. The combustion fluids 21 are directed out of the openings 69 (see FIGS. 3C and 6).

Because the openings 69 are located on one side of the nozzle section, the combustion fluids 21 are directed to that one side. The expulsion of combustion fluids on one side creates a reverse action, or reaction, force 101 which reaction force causes the perforating tool to move in the direction opposite of the openings 69. The reaction force 101 is such that the perforating tool 31 is held firmly against the inside diameter of the tubing 15, even when the perforating tool is subjected to the pressure wave. Thus, the perforating tool is able to resist the reflected pressure wave 23 from the closure 17. This results in the perforating tool being held at the same section of tubing so that the combustion fluids 21 remain directed on to the same area of tubing. The combustion fluids 21 form an opening 103 in the tubing (see FIG. 7, which shows the perforating tool after the combustion fluids have dissipated and the perforating tool has returned to the center of the tubing).

Figure 8:
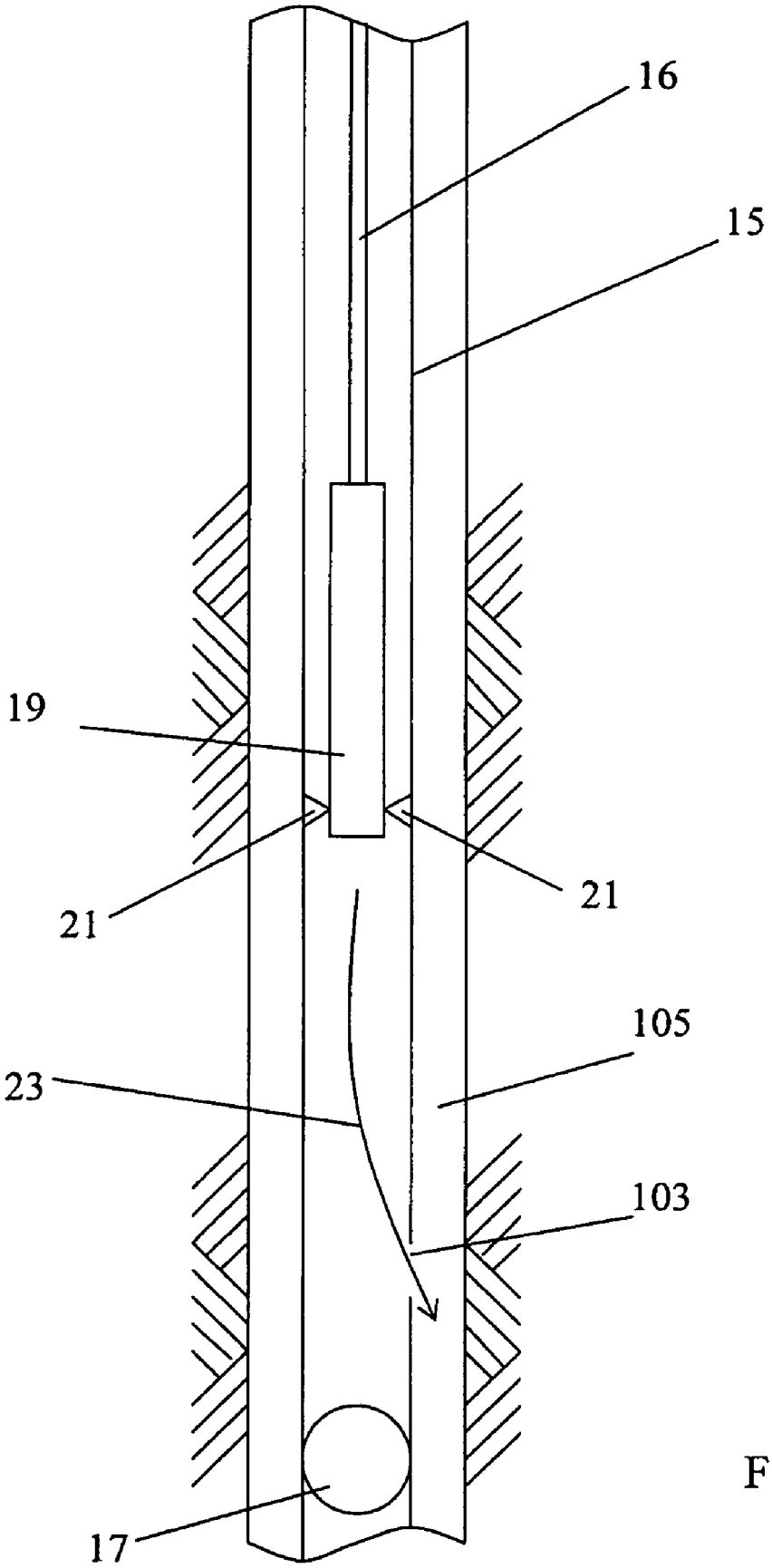

Next, the perforating tool is removed and replaced by the radial cutting torch 19 (see FIG. 8). The radial cutting torch 19 is positioned in the tubing above the opening. The radial cutting torch is operated in a normal manner, wherein combustion fluids are produced in a 360 degree circumference around the tool. The pressure wave 23 is vented out of the tubing 15 through the opening 103. The pressure wave enters the annulus 105 where it is dissipated in both directions, but outside of the tubing 15. Some reflection of the pressure wave likely occurs at the opening, but the reflected pressure wave is too attenuated to adversely move the radial cutting torch 19. The combustion fluids 21 remain concentrated on one narrow band of the tubing, resulting in the tubing 15 being cut. The radial cutting torch is retrieved, followed by retrieval of the tubing above the cut.

The amount of reaction force needed on the perforating tool depends on the strength of the pressure wave 23 that impacts the perforating tool. The strength of the pressure wave is dependent upon several factors such as the amount and type of fuel used. Another factor is the distance of the perforating tool from the closure and the clearance between the perforating tool and the tubing. The closer the perforating tool is placed to the closure, the stronger the pressure wave that impacts the perforating tool and the more likely the impact of the pressure wave is to coincide at the same time that the combustion fluids are cutting the pipe. The smaller the clearance between the outside diameter of the perforating tool and the inside diameter of the pipe, the stronger the pressure wave, as the bulk of pressure wave is encountered by the perforating tool and not bypassed through the clearance. The density and make up of the drilling fluids inside of the pipe also have a bearing on the pressure wave, as some drilling fluids are more efficient in propagating pressure waves.

Furthermore, the more energy required to form the pipe opening, the larger the pressure wave is likely to be created, requiring a greater reaction force. A larger opening and thicker pipe wall requires more energy from the combustion fluids to form the pipe opening. Thus, an opening that requires a large amount of energy will likely have a larger pressure wave. The larger pressure wave can be compensated for with a larger reaction force. A larger reaction force can be created by narrowing the arc A (see FIG. 3B) of the openings 69.

Figure 9:
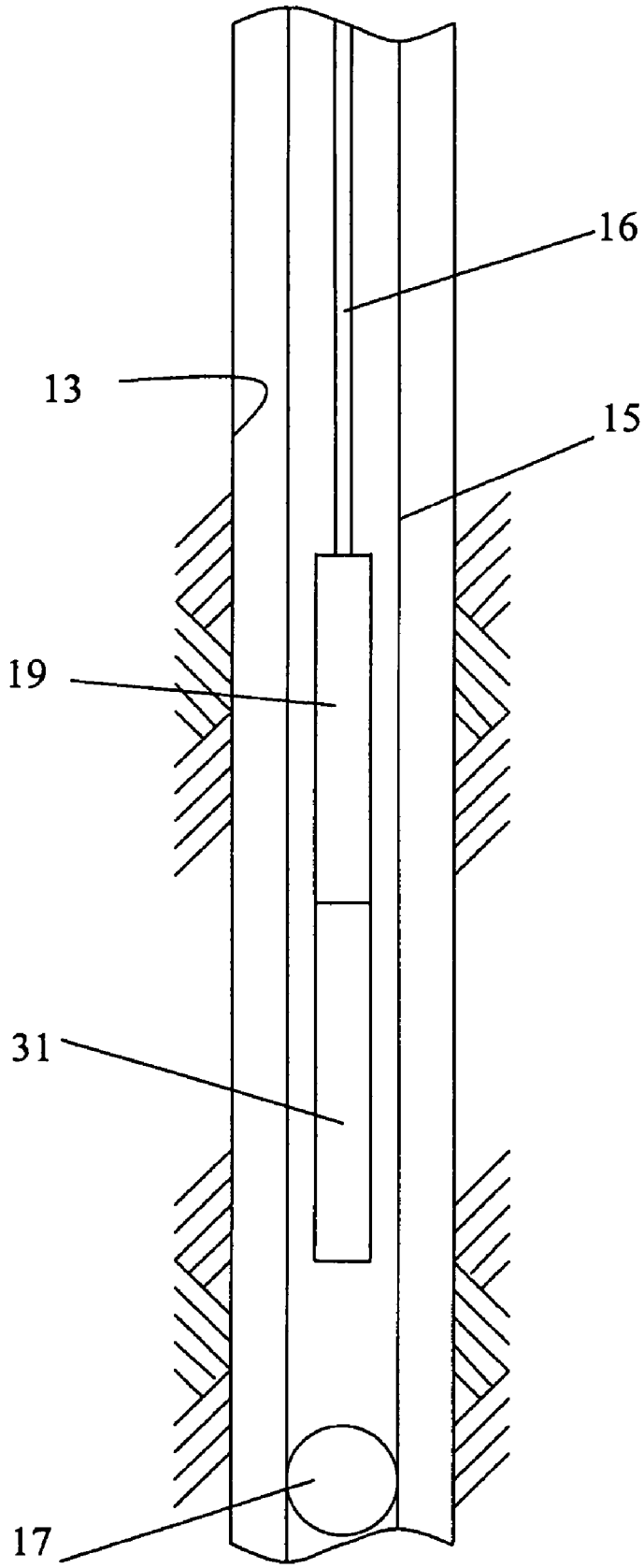
FIG. 9 illustrates the perforating tool and cutting torch in tandem, in accordance with an embodiment of the present disclosure.

FIG. 9 shows the perforating tool 31 and the radial cutting torch 19 located on the same wireline 16 together, in tandem. The perforating tool 31 and the radial cutting torch 19 are operated as described above with respect to FIGS. 5-8, except that the two tools are lowered together into the pipe 15. Thus, after operating the perforating tool 31 and creating an opening 103, the perforating tool is not removed before operating the radial cutting torch. Instead, both tools are left down in the pipe and the radial cutting torch is operated so as to sever the pipe. Then both tools can be retrieved together.

FIG. 9 shows the perforating tool located below the radially cutting torch. The radial cutting torch could be located below the perforating tool. Once the perforating tool is operated, the radial cutting torch can be positioned in the pipe at the desired location. Thus, the radial cutting torch can be raised or lowered in the pipe.

Although the perforating tool has been described in conjunction with a cutting torch, the perforating tool 31 can be used without a cutting torch 19. For example, if drill pipe becomes stuck in the borehole, it is desirable to create one or more large holes in the drill pipe to allow circulation. The perforating tool is used to create one or more large openings in the drill pipe. The perforating tool can be used close to and above the check valve or other closure 17 in the drill pipe. In this operation, the opening pattern and the nozzle section can be a relatively large circular opening. The diameter of the opening is such that a backward reaction force is created to pin the perforating tool against the drill pipe. The radial cutting torch is not used in this scenario.

In addition, the perforating tool 31 can be used for correcting cement jobs. Typically, cement is pumped down inside casing to the bottom and then back up around the outside of the casing. On occasion, the cement around the outside of the casing has voids. The perforating tool 31 can be used to create an opening in the casing at the void. Once the opening is created, cement can be pumped down the inside of the casing, out through the opening and into the void. The perforating tool can generate large openings which allow the cement to be pumped through at high volumes and high flow rates.

The perforating tool 31 can be used to create openings in pipe such as casing for introducing loss circulation materials into the borehole.

Because of the piston 59 and its seal 60, the perforating tool can be used in high pressure applications, such as deep wells.

The foregoing disclosure and showings made in the drawings are merely illustrative of the principles of embodiments described herein and are not to be interpreted in a limiting sense.

What is claimed:

1. A method for forming an opening in a downhole tubular within a wellbore, the method comprising:

positioning an apparatus adapted to form an opening in the downhole tubular into the wellbore;

actuating the apparatus by moving a piston within the apparatus to thereby produce and eject the cutting fluids from the apparatus in a first direction to form the opening in the downhole tubular, wherein producing and ejecting of the cutting fluids produces a reaction force, and wherein the reaction force moves the apparatus in a second direction opposite the first direction to at least partially anchor the apparatus within the wellbore; and continuing actuation of the apparatus while the apparatus is at least partially anchored within the wellbore to form the opening in the downhole tubular.

2. The method of claim 1, wherein the step of continuing actuation of the apparatus to form the opening in the downhole tubular comprises perforating the downhole tubular, cutting the downhole tubular, or combinations thereof.

3. The method of claim 1, wherein production of the cutting fluids further produces a pressure wave, the method further comprising the step of permitting the pressure wave to dissipate through the opening in the downhole tubular.

4. The method of claim 3, wherein the step of lowering the apparatus comprises lowering the apparatus to a selected distance from a closure in the downhole tubular, and wherein the pressure wave further comprises a magnitude based on the distance of the apparatus from the closure.

5. The method of claim 1, wherein the reaction force anchors the apparatus against the interior of the downhole tubular.

6. A method for forming an opening in a downhole tubular having an obstruction, the method comprising:

lowering an apparatus adapted to perforate or cut the downhole tubular into the wellbore to a selected distance from the obstruction; and actuating the apparatus to begin perforating or cutting the downhole tubular by moving a piston within the apparatus and thereby producing cutting fluids from the apparatus, wherein acutation of the apparatus generates a reaction force and a pressure wave that impacts the obstruction and is reflected toward the apparatus, and wherein the reaction force moves the apparatus to a position that reduces exposure of the apparatus to the pressure wave.

7. The method of claim 6, wherein the downhole tubular has a wall thickness, and the opening has a size, and wherein the determined pressure wave further comprises a magnitude based on the wall thickness, the size of the opening, the selected distance from the obstruction, a distance between the apparatus and the interior of the downhole tubular, or combinations thereof.

8. The method of claim 6, wherein the downhole tubular has a drilling fluid with a density, and wherein the pressure wave further comprises a magnitude based on the density.

9. The method of claim 6, the method further comprising continuing perforating or cutting of the downhole tubular while the apparatus is in the position to form the opening in the downhole tubular.

10. An apparatus for forming an opening in a downhole tubular, the apparatus comprising:

a) a fuel section comprising combustible material;

b) an igniter section coupled to the fuel section, further comprising an igniter to ignite the combustible material so as to produce cutting fluids; and c) a nozzle section in communication with the fuel section, the nozzle section comprising a piston movable between a closed position and an open position, wherein the nozzle section is configured to direct cutting fluids in a first direction, and to produce a determined reaction force in a second direction.

11. The apparatus of claim 10, wherein the piston prevents fluid communication between the fuel section and a nozzle section opening when in the closed position, and wherein the piston permits fluid communication between the fuel section and the nozzle section opening when in the open position.

12. The apparatus of claim 10, further comprising at least two openings in the nozzle section, wherein the at least two openings are spaced circumferentially relative to each other, and wherein the at least two openings direct cutting fluids along parallel trajectories.

13. The method of claim 10, wherein the combustible material comprises at least one of thermite, a thermite mixture, or combinations thereof.

14. A method for forming an opening in a downhole tubular, the method comprising:

a) positioning an apparatus in the downhole tubular, the apparatus further comprising a nozzle section and a piston disposed within the nozzle section actuatable between a first position and a second position;

b) actuating the piston to the second position;

c) producing cutting fluids in a first direction toward the downhole tubular to form the opening, wherein the production of cutting fluids generates a reaction force; and d) using the reaction force to position the apparatus to enhance the formation of the opening in the downhole tubular.

15. A method for severing a tubular string, the method comprising:

a) forming a first opening in the tubular string with a first apparatus;

b) positioning a radial cutter within the tubular string; and c) actuating the radial cutter to radially cut the tubular string, wherein actuation of the radial cutter produces a pressure wave.

16. The method of claim 15, wherein the step of positioning the radial cutter within the tubular string comprises positioning the radial cutter above the opening for facilitating attenuation of the pressure wave through the opening.

17. The method of claim 15, wherein the pressure wave is dissipated through the opening for preventing the pressure wave from affecting the operation of the radial cutter.

18. The method of claim 17, wherein before the step of forming the first opening in the tubular string occurs, the method comprises:

lowering the first apparatus into the tubular string; and actuating the first apparatus to produce cutting fluids in a first direction to form the opening, wherein production of the cutting fluids produces a reaction force, and wherein the reaction force moves the first apparatus in a second direction opposite the first direction to enhance forming of the opening.

19. The method of claim 15, wherein the radial cutter is operatively connected with the first apparatus.

20. The method of claim 15, the method further comprising continuing actuation of the first apparatus while the first apparatus is moved in the second direction to form the opening in the tubular string.

* * * * *